US005634301A

United States Patent [19]

Koller

[11] Patent Number: 5,634,301

[45] Date of Patent: Jun. 3, 1997

[54] STUD WALL RAISING APPARATUS

[76] Inventor: Jacob F. Koller, P.O. Box 2238, Robertsdale, Ala. 36567

[21] Appl. No.: 582,176

[22] Filed: Jan. 2, 1996

[51] Int. Cl.[6] ..... E04G 21/04

[52] U.S. Cl. ..... 52/127.2; 52/DIG. 6; 52/749.1

[58] Field of Search ..... 52/146, 148, 149, 52/152, 704, 749.1, DIG. 1, DIG. 6, 127.2

[56] References Cited

U.S. PATENT DOCUMENTS 4,068,427 1/1978 Camardo ..... 52/127.2 X
5,322,404 6/1994 Keller ..... 52/749.1 X
5,343,667 9/1994 Peden ..... 52/127.2 X

*Primary Examiner*—Creighton Smith
*Attorney, Agent, or Firm*—Peter Loffler

[57] ABSTRACT

A stud wall raising apparatus is disclosed. The device permits a single user to safely and easily raise a stud wall without assistance. The device comprises a wall fixture having a pair of perpendicularly oriented channels for receiving the top portion of the stud wall. A fixed brace is hingedly attached to the wall fixture, while a movable brace is attached to the fixed brace by a plurality of lock bars. A support member is received between the fixed brace and the movable brace with serrated edges on each brace engaging and securing the support member therebetween.

20 Claims, 4 Drawing Sheets

54
14
50
52
52
40
38
32
34
30

STUD WALL RAISING APPARATUS

BACKGROUND OF THE INVENTION

1. Field of the Invention

The present invention relates to an apparatus for assisting in raising a stud wall or other type of construction wall from a horizontal to a vertical position.

2. Background of the Prior Art

The process of standing a stud wall begins with the construction of the stud wall on a horizontal surface such as a floor or a slab foundation. The stud wall includes top and bottom plates and a plurality of structural members, or studs, joining the top and bottom plates. Standing a stud wall typically requires a minimum of three workers to accomplish the task safely and easily. The stud wall is urged into a vertical position and held in place by two workers as a third worker secures the stud wall to other building structures.

This process works efficiently when the necessary manpower is present. However, with the trend toward do-it-yourself home building as well as the use of skeleton crews by commercial builders, the requisite minimum of three workers to stand a stud wall is not always available. When only two workers, such as a husband and wife building their own home, attempt to raise a stud wall the potential for serious injury is ever present.

Therefore, a need in the art exists for a stud wall raising apparatus that allows a single individual to raise a stud wall so that the stud wall can be properly positioned and attached to other building structures. Such an apparatus must be simple to use, such that it can be operated by construction workers and lay persons alike. Furthermore, the device should be inexpensive to manufacture and be durable in use in a commercial setting.

SUMMARY OF THE INVENTION

The stud wall raising apparatus of the present invention meets the aforementioned needs in the art. The stud wall raising apparatus is designed to be operated by a single worker permitting the worker to stand the stand wall without assistance. The device is easy to attach to and remove from the stud wall and is durable in operation and inexpensive to manufacture.

The stud wall raising apparatus comprises a generally T-shaped wall fixture, a fixed stud brace attached to the wall fixture by hinge means, a movable stud brace, and a plurality of lock bars connecting the fixed and movable stud braces.

In order to utilize the device, the wall fixture receives and secures the top section of a stud wall while the wall is in a horizontal position. A support member, such as a 2-by-4 beam, is received between the fixed and movable brace. Serrated edges located on the ends of the fixed and movable braces, engage the support member and hold the support member in place. Thereafter, the user begins standing the wall. As the stud wall is being raised, the support member and the fixed and movable braces rotate in relation to the arcing of the top of the stud wall. Once the stud wall is in its proper vertical position, the wall is attached to the building fixtures as appropriate and the stud wall raising apparatus is removed from the stud wall.

BRIEF DESCRIPTION OF THE DRAWINGS

Similar reference numerals refer to similar parts throughout the several views of the drawings.

DETAILED DESCRIPTION OF THE PREFERRED EMBODIMENT

Figure 1:
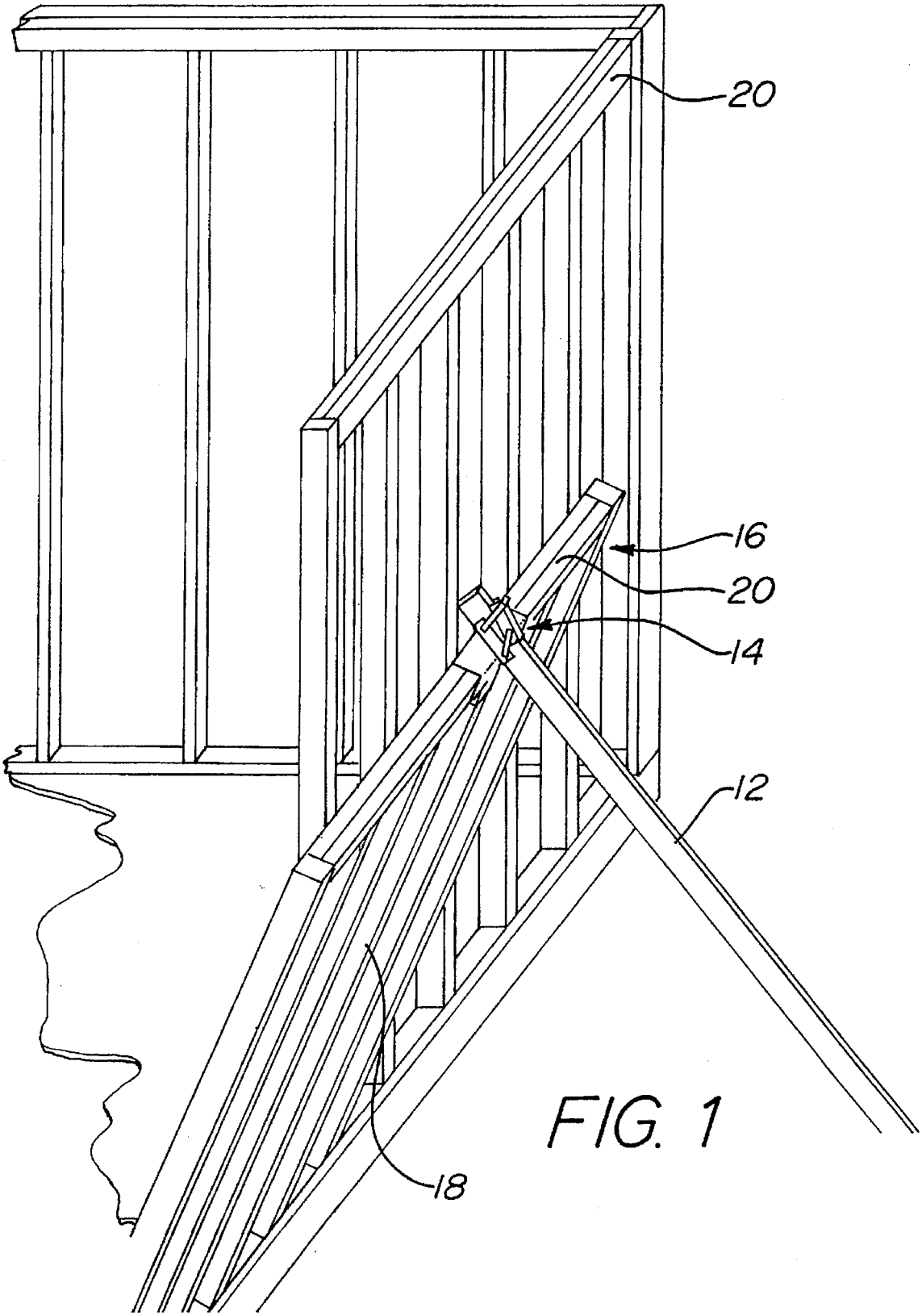
FIG. 1 illustrates the stud wall raising apparatus of the present invention attached to the mounting beam of a stud wall.
Figure 2:
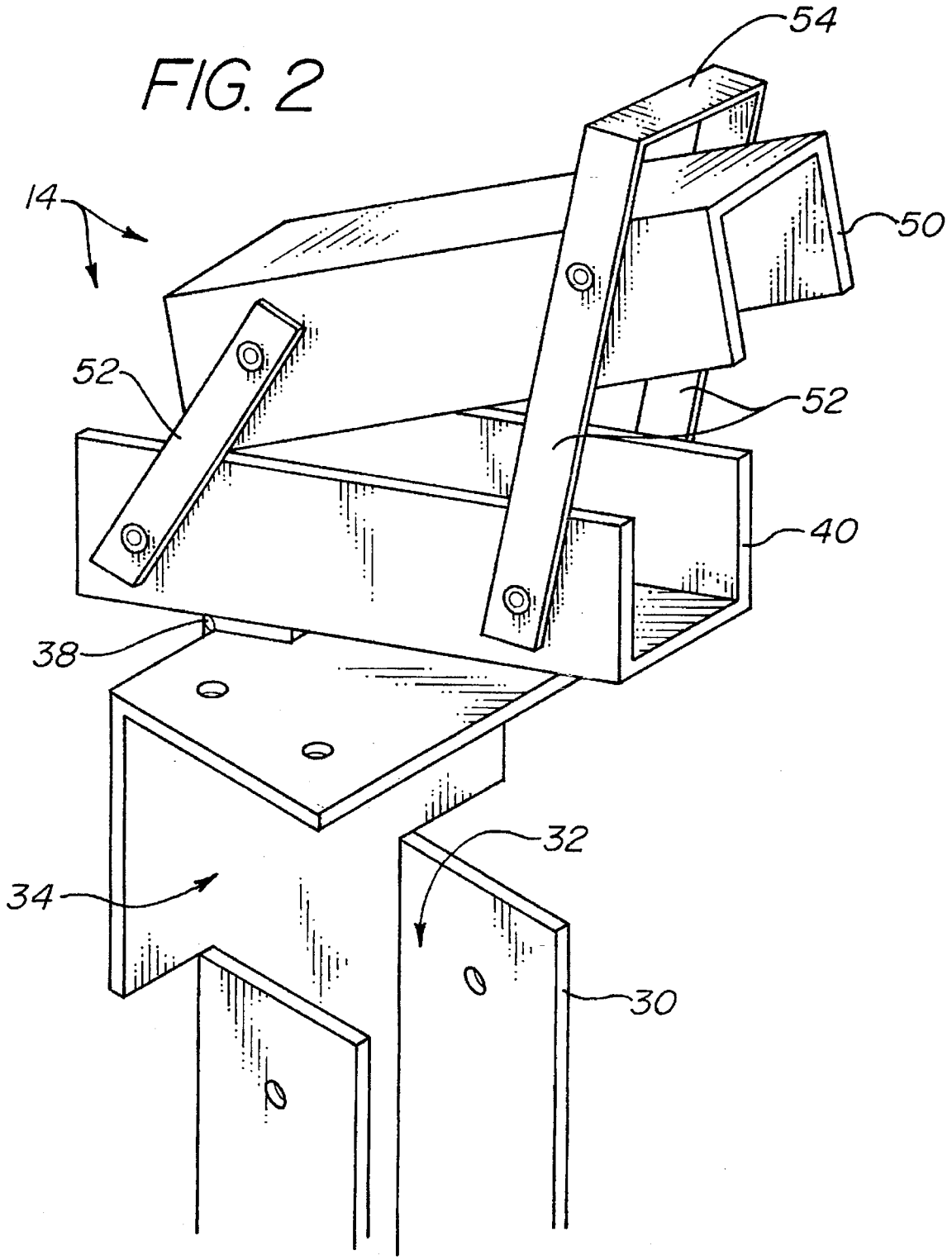
FIG. 2 is a perspective view of the stud wall raising apparatus.
Figure 4:
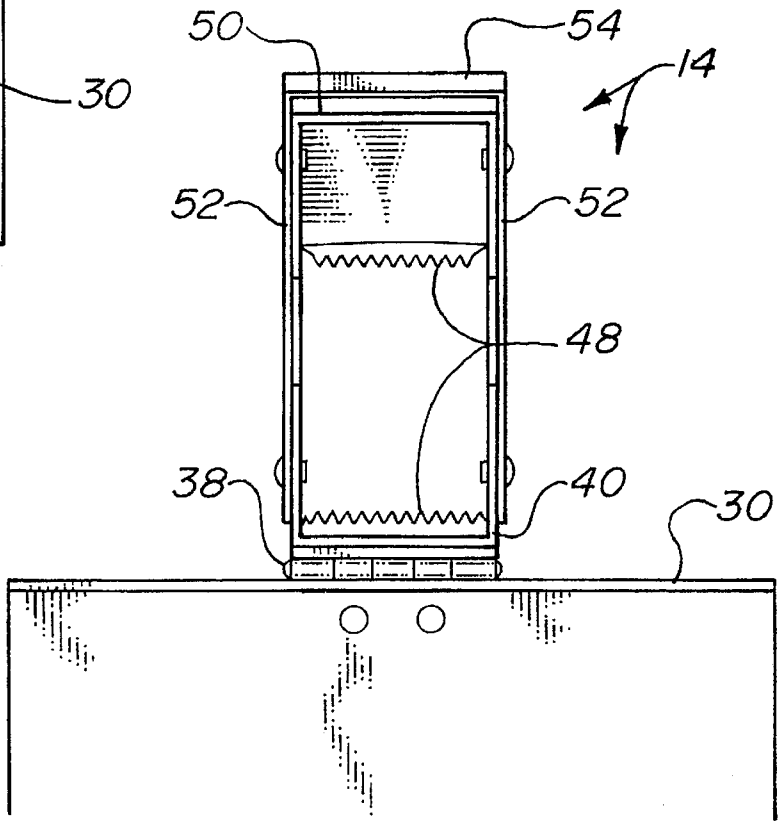
FIG. 4 is a front elevation view of the stud wall raising apparatus.
Figure 3:
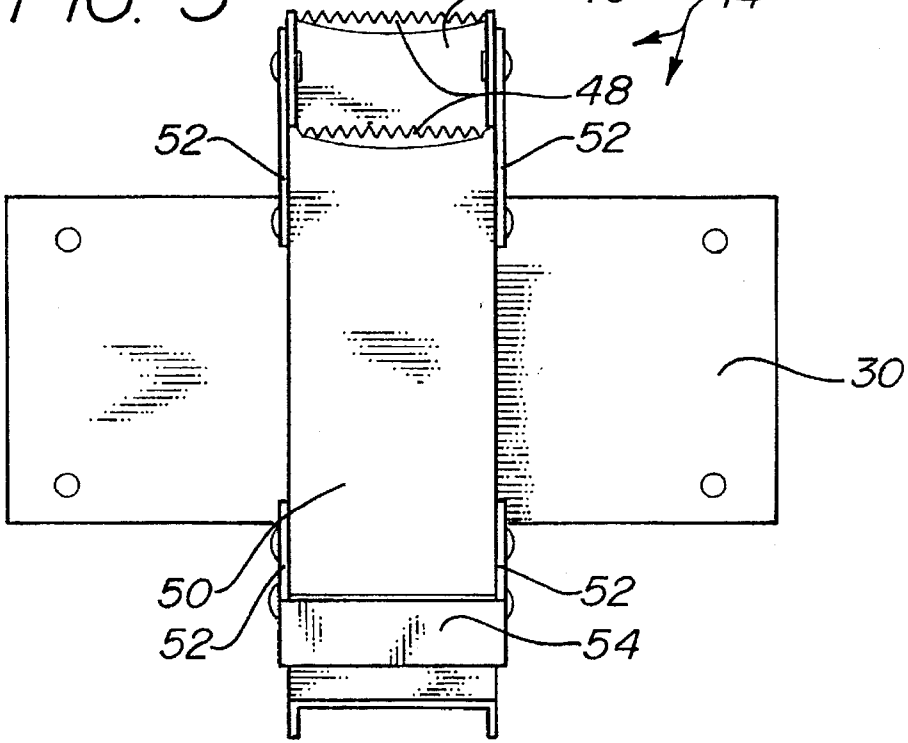
FIG. 3 is a top plan view of the stud wall raising apparatus.
Figure 5:
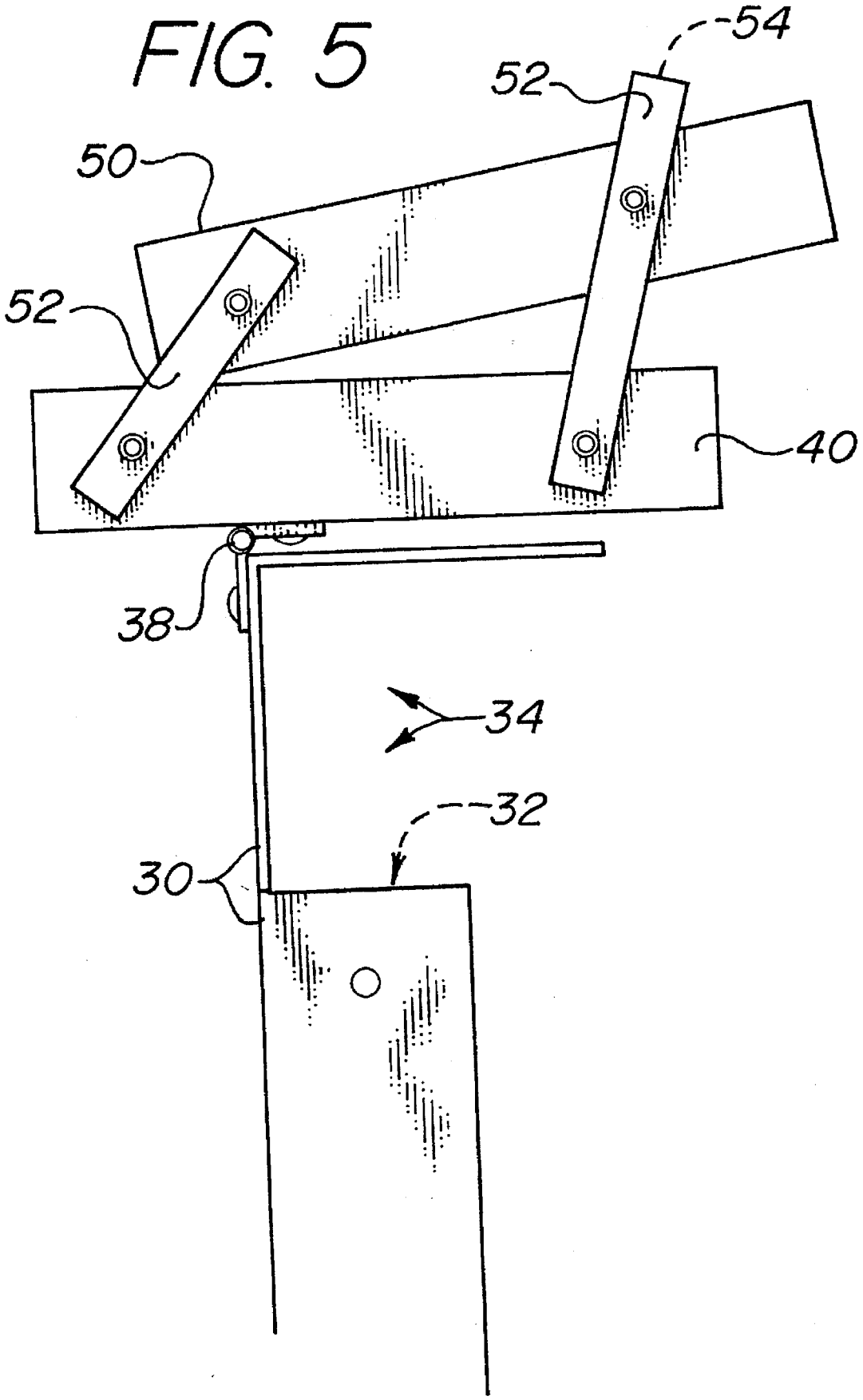
FIG. 5 is a side elevation view of the stud wall raising apparatus.

Referring now to the drawings, it is seen that the stud wall raising apparatus of the present invention, generally referred to by reference numeral 14, comprises a generally T-shaped wall fixture 30. The wall fixture 30 has a first channel 32 having a generally U-shape, and a second channel 34 having a generally L-shape, in perpendicular orientation to the first channel 32.

A generally U-shaped fixed brace 40 is rotatably attached to the wall fixture 30 by hinge means 38. A generally U-shaped movable brace 50 is pivotally attached to the fixed brace 40 by a plurality of lock bars 52, at least two lock bars 52 on either side of the braces. The lock bars 52 permits the movable brace 50 to translate relative to the fixed brace 40. At least one pair of the lock bars 52 has a top bar 54 connecting the pair in order to prevent over-translation of the movable brace 50. A serrated edge 48 is located at one end of the fixed brace 40 while a second serrated edge 48 is located at one end of the movable brace 50.

In order to utilize the stud wall raising apparatus 14, the wall fixture is attached to a stud wall 16 while the stud wall 16 is in a horizontal position. The wall fixture 30 is positioned such that the top plate 20 of the stud wall is received and secured within the second channel 34 while an individual stud 18 of the stud wall 16 is received within the first channel 32. Thereafter, a support member 12 is received and secured between the fixed brace 40 and the movable brace 50. The serrated edges 48 located on the ends of the two braces engage and help secure the support member 12. The support member 12 can be any relatively long thin beam member such as a 2-by-4 beam.

Once the support member 12 is secured within the fixed brace 40 and the movable brace 50, the standing process begins. The user grasps the support member and moves it toward the stud wall 16 in order to swing the stud wall 16 from its initial horizontal position to its final vertical position. As the stud wall is being raised, the fixed brace 40 and its attached movable brace 50 and support member 12 received therebetween rotate in relation to the arcing of the top of the stud wall 16. Rotation is permitted by hinge means 38. Once the stud wall 16 is in its vertical position, the stud wall 16 is secured to other fixtures of the building and the wall fixture 30 is removed.

While the invention has been particularly shown and described with reference to an embodiment thereof, it will be understood by those skilled in the art that various changes in form and detail may be made without departing from the spirit and scope of the invention.

I claim:

1. A portable stud wall standing apparatus comprising:

a connecting fixture;

a first brace, having a serrated edge at one end, hingedly attached to the connecting fixture;

a second brace having a serrated edge at one end;

a plurality of locking bar means connecting the first brace with the second brace allowing translation of the second brace relative to the first brace.

2. The device as in claim 1 wherein the connecting fixture is generally T-shaped having a first generally U-shaped channel and a second generally L-shaped channel in perpendicular orientation to the first channel.

3. The device as in claim 1 wherein the first brace is generally U-shaped and the second brace is generally U-shaped in opposing orientation to the first brace.

4. The device as in claim 3 in combination with a support member received and secured between the first brace and the second brace.

5. The device as in claim 4 wherein the support member is a relatively long thin beam member.

6. The device as in claim 1 in combination with a support member received between the first brace and the second brace and secured therebetween by the serrated edge of the first brace and the serrated edge of the second brace.

7. The device as in claim 6 wherein the support member is a relatively long thin beam member.

8. A portable stud wall standing apparatus comprising:

a connecting fixture which is generally T-shaped having a first generally U-shaped channel and a second generally L-shaped channel in perpendicular orientation to the first channel;

a first brace hingedly attached to the connecting fixture;

a second brace;

a plurality of locking bar means connecting the first brace with the second brace allowing translation of the second brace relative to the first brace.

9. The device as in claim 8 wherein the first brace has a serrated edge at one end and the second brace has a serrated edge at one end.

10. The device as in claim 8 wherein the first brace is generally U-shaped and the second brace is generally U-shaped in opposing orientation to the first brace.

11. The device as in claim 10 in combination with a support member received and secured between the first brace and the second brace.

12. The device as in claim 11 wherein the support member is a relatively long thin beam member.

13. The device as in claim 9 in combination with a support member received between the first brace and the second brace and secured therebetween by the serrated edge of the first brace and the serrated edge of the second brace.

14. The device as in claim 13 wherein the support member is a relatively long thin beam member.

15. A portable stud wall standing apparatus comprising:

a connecting fixture;

a generally U-shaped first brace hingedly attached to the connecting fixture;

a generally U-shaped second brace in opposing orientation to the first brace;

a plurality of locking bar means connecting the first brace with the second brace allowing translation of the second brace relative to the first brace.

16. The device as in claim 15 wherein the first brace has a serrated edge at one end and the second brace has a serrated edge at one end.

17. The device as in claim 15 wherein the connecting fixture is generally T-shaped having a first generally U-shaped channel and a second generally L-shaped channel in perpendicular orientation to the first channel.

18. The device as in claim 15 in combination with a support member received and secured between the first brace and the second brace.

19. The device as in claim 18 wherein the support member is a relatively long thin beam member.

20. The device as in claim 16 in combination with a support member received between the first brace and the second brace and secured therebetween by the serrated edge of the first brace and the serrated edge of the second brace.

* * * * *